US009927069B2

(12) United States Patent
Espinasse

(10) Patent No.: US 9,927,069 B2
(45) Date of Patent: Mar. 27, 2018

(54) SYSTEM FOR TRANSFERRING A FLUID, ESPECIALLY LIQUEFIED PETROLEUM GAS, BETWEEN A FIRST SURFACE INSTALLATION AND A SECOND SURFACE INSTALLATION

(75) Inventor: Philippe François Espinasse, Bihorel (FR)

(73) Assignee: TECHNIP FRANCE (FR)

( * ) Notice: Subject to any disclaimer, the term of this patent is extended or adjusted under 35 U.S.C. 154(b) by 276 days.

(21) Appl. No.: 14/000,047

(22) PCT Filed: Mar. 6, 2012

(86) PCT No.: PCT/IB2012/000415

§ 371 (c)(1),
(2), (4) Date: Aug. 16, 2013

(87) PCT Pub. No.: WO2012/114198

PCT Pub. Date: Aug. 30, 2012

(65) Prior Publication Data

US 2013/0333804 A1 Dec. 19, 2013

(30) Foreign Application Priority Data

Feb. 22, 2011 (FR) ..... 11 00526

(51) Int. Cl.
*F17D 1/08* (2006.01)
*B63B 27/24* (2006.01)
*B63B 27/30* (2006.01)

(52) U.S. Cl.
CPC ..... *F17D 1/08* (2013.01); *B63B 27/24* (2013.01); *B63B 27/30* (2013.01)

(58) Field of Classification Search
CPC ..... F17D 1/08
(Continued)

(56) References Cited

U.S. PATENT DOCUMENTS 729,992 A * 6/1903 Baker, Jr. ..... 141/383
1,685,927 A * 10/1928 Miller ..... 141/1
(Continued)

FOREIGN PATENT DOCUMENTS

DE 30 26 836 2/1982
EP 0 679 606 A1 11/1995
(Continued)

OTHER PUBLICATIONS

International Search Report dated Sep. 13, 2012 issued in corresponding International patent application No. PCT/IB2012/000415.

*Primary Examiner* — Timothy L Maust
*Assistant Examiner* — Andrew Schmid
(74) *Attorney, Agent, or Firm* — Ostrolenk Faber LLP

(57) ABSTRACT

The present disclosure relates to a system (10) for transferring fluid between a first surface installation (11) and a second surface installation (12), comprising a tubular transfer conduit (25) that can be deployed between the two surface installations, the first end (28) of the conduit being connected to piping of the first surface installation (11) while the second end (29) is intended to be connected to a collector (20) of the second surface installation (12), said tubular transfer conduit (25) being suspended beneath a support and guidance structure (40) by a link (52). The tubular transfer conduit (25) comprises a first flexible section (30) extending in the form of a catenary, a second flexible section (32) extending essentially vertically, the fiber end (29) thereof emerging at the bottom being provided with a connection device (27) to be connected to the collector (20) of the second surface installation (12), and an elbow connection (31) arranged between the first and the second flexible section (32), the tubular transfer conduit (25) being suspended beneath the support and guidance structure (40) by
(Continued)

means of a link (52) connecting the support structure (40) and an elbow connection point (31).

8 Claims, 3 Drawing Sheets

(58) Field of Classification Search
USPC ..... 141/330, 346, 348, 352, 355, 363, 364, 141/365, 382, 383
See application file for complete search history.

(56) References Cited

U.S. PATENT DOCUMENTS

| | | | | |
|---|---|---|---|---|
| 3,032,082 | A * | 5/1962 | Vilain | B67D 9/02 137/615 |
| 3,085,593 | A * | 4/1963 | Sorensen | 137/615 |
| 3,236,267 | A * | 2/1966 | Bily | 141/1 |
| 3,528,462 | A * | 9/1970 | Quase | 141/284 |
| 3,568,737 | A * | 3/1971 | Burns | 141/383 |
| 4,261,398 | A * | 4/1981 | Haley | 141/387 |
| 4,690,181 | A * | 9/1987 | Carrio | 141/388 |
| 4,867,211 | A * | 9/1989 | Dodge et al. | 141/279 |
| 5,348,423 | A * | 9/1994 | Maloberti et al. | 405/166 |
| 5,380,129 | A * | 1/1995 | Maloberti et al. | 405/166 |
| 5,449,252 | A * | 9/1995 | Maloberti et al. | 405/166 |
| 6,412,433 | B1 * | 7/2002 | Breivik et al. | 114/230.1 |
| 6,415,828 | B1 * | 7/2002 | Duggal et al. | 141/387 |
| 6,688,348 | B2 * | 2/2004 | Fontenot | 141/387 |
| 7,299,835 | B2 * | 11/2007 | Dupont et al. | 141/382 |
| 8,122,919 | B2 * | 2/2012 | Park | 141/279 |
| 8,622,099 | B2 * | 1/2014 | Liem et al. | 141/59 |
| 8,864,420 | B2 * | 10/2014 | Foo et al. | 405/211 |
| 8,915,271 | B2 * | 12/2014 | Liu | 141/382 |
| 2003/0091396 | A1 * | 5/2003 | Barras et al. | 405/158 |
| 2003/0172991 | A1 * | 9/2003 | de Baan | 141/382 |
| 2004/0154697 | A1 * | 8/2004 | Dupont et al. | 141/382 |
| 2006/0048850 | A1 * | 3/2006 | Espinasse | 141/387 |
| 2008/0309077 | A1 * | 12/2008 | Espinasse et al. | 285/259 |
| 2010/0018717 | A1 * | 1/2010 | Espinasse et al. | 166/346 |
| 2012/0298373 | A1 * | 11/2012 | Luppi et al. | 166/350 |
| 2013/0333804 | A1 * | 12/2013 | Espinasse | 141/382 |
| 2014/0041262 | A1 * | 2/2014 | Espinasse et al. | 37/313 |

FOREIGN PATENT DOCUMENTS

| | | |
|---|---|---|
| FR | 634461 | 2/1928 |
| FR | 1415279 | 10/1965 |
| FR | 2 971 762 | 8/2012 |
| GB | 880699 | 10/1961 |
| SU | 925749 | 5/1982 |
| WO | WO 02/092422 A1 | 11/2002 |

* cited by examiner

SYSTEM FOR TRANSFERRING A FLUID, ESPECIALLY LIQUEFIED PETROLEUM GAS, BETWEEN A FIRST SURFACE INSTALLATION AND A SECOND SURFACE INSTALLATION

CROSS REFERENCE TO RELATED APPLICATIONS

The present application is a 35 U.S.C. § 371 National Phase conversion of PCT/IB2012/000415, filed Mar. 6, 2012, which claims benefit of French Application No. 11/00526, filed Feb. 22, 2011, the disclosure of which is incorporated herein by reference. The PCT International Application was published in the French language.

BACKGROUND OF THE INVENTION

The invention relates to a system for transferring a fluid between a first surface installation and a second surface installation floating on an expanse of water, such as a sea or an ocean, for example. This transfer system in particular comprises a tubular conduit whereof one of the ends is connected to the piping of the first surface installation and whereof the other end is designed to be connected to the manifold of a second surface installation. The tubular conduit is supported by a support structure that may be deployed between a storage position on the first surface installation and a position deployed to connect the end of the tubular conduit to the manifold of the second surface installation.

The first surface installation is for example a floating production storage and offloading ship (FPSO).

The second surface installation is for example a floating liquefied hydrocarbon storage and transport ship, in particular for liquefied petroleum gas (LPG), in order to transport it from the floating treatment plant to a land-based site.

In light of the security constraints imposed due to the hazardous nature of the transported fluids and the environment in which those fluid transfers occur, the fluid transfer system must be suitable for bearing major dynamic stresses without any risk of damage to the fluid transfer system.

Known from WO02092422 are systems of this type for transferring liquefied natural gas (LNG) between two installations. This device comprises a cryogenic hose that deploys in a catenary between the two surface installations. One end of the cryogenic hose is connected to the piping of a first installation while the second free end is designed to be connected to a manifold of a second surface installation. The free end of the cryogenic conduit is connected to the first end of a hinged arm that makes it possible to guide the free end of the flexible cryogenic conduit and connect it on the manifold of the second surface installation. This arm is suspended below the stationary support structure by its ends using cables. The first end of the arm on which the flexible cryogenic conduit is connected is linked to the support structure by a cable that can be unwound from a winch located on the stationary support structure while the second end of the arm is linked to the stationary support structure by a cable. It also comprises a counterweight.

The end of the cryogenic conduit is therefore guided to be connected to the manifold of the second surface installation by a hinged arm suspended by its ends from a stationary structure. The suspension of the arm by a cable and a counterweight at the end of the arm ensures a state of stable equilibrium and further makes it possible to reduce the maneuvering forces during the connection to the manifold of the surface installation and the forces thereon, including during the transfer.

However, one drawback of the system is that it is not suitable when the transfer is done between two ships moored to one another and where the heights of the freeboards of the two ships are very different, as is for example the case between an FPSO and a liquefied petroleum gas storage ship during the LPG transfer. In fact, the support structure, and in particular the hinged guide arm, is bulky and is not easily adaptable to the aforementioned configuration. Another drawback of the system is that it does not make it possible to effectively compensate for the primary movements of the boats, mainly heaving. In fact, the hinged arm has considerable movement inertia, which creates significant forces at the manifold requiring the reinforcement thereof.

The fluid transfer system according to the invention is an improvement of the device of the prior art in the applicant's name, and aims to resolve the aforementioned drawbacks.

SUMMARY OF THE INVENTION

The system according to the invention for transferring a fluid between a first surface installation and a second surface installation comprises a tubular transfer conduit that can be deployed between the two surface facilities, the first end of which is connected to a piping of the first surface installation while the second end is designed to be connected to a manifold of the second surface installation, the tubular transfer conduit being suspended below a support and guide structure by a link, for example a cable.

The fluid transfer system according to the present invention is characterized in that the tubular transfer conduit consists of:

- a first flexible section extending in a catenary;
- a second flexible section extending substantially vertically, the free end of which emerging downward is provided with a connection device designed to be connected to the manifold of the second surface installation,
- an elbow connection positioned between the first and second flexible sections, and in that the tubular transfer conduit is suspended below the support and guide structure by a link linking the support structure and a point of the elbow connection.

According to another feature of the invention, the second flexible section has a length greater than 10 m.

According to still another feature of the invention, the elbow connection is rigid and provided with flexible/rigid connectors at each of its opposite ends and has two rectilinear sections, the axes of which form an angle comprised between 30° and 120°.

According to still another feature of the invention, the support and guide structure is a hinged arm rotatably mounted around a horizontal axis on the first surface installation and bears a winch to deploy a given link length between the hinged arm and the point of the elbow connection.

According to still another feature of the invention, the hinged arm comprises a first arm mounted on the first surface installation and at the end of which a second arm is rotatably mounted supporting a counterweight, thereby forming a swing tray and making it possible to stabilize a state of equilibrium during the connection of the end of the second flexible conduit on the manifold of the second surface installation.

BRIEF DESCRIPTION OF THE DRAWINGS

Other features and advantages of the invention will emerge from the description of one preferred embodiment of the invention done in reference to the appended diagrammatic drawings, which show.

DESCRIPTION OF PREFERRED EMBODIMENTS

Figure 4:
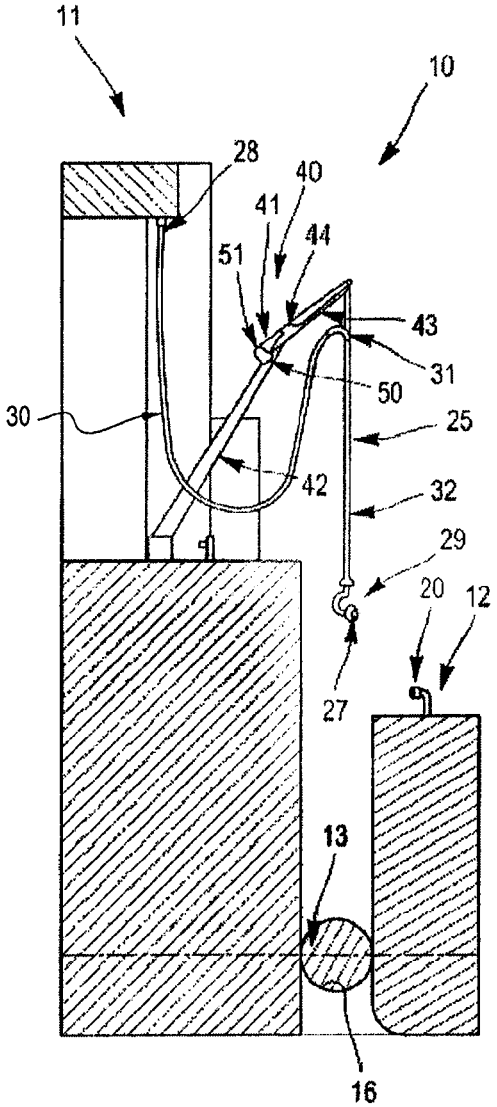

FIG. 4 shows the fluid transfer system (10) deployed between a first surface installation (11) and a second surface installation (12). The first surface installation (11) is for example an FPSO ship and the second surface installation (12) is for example a liquefied petroleum gas (LPG) storage ship. The fluid transfer system (10) also makes it possible to transfer LPG from the production and processing ship to a storage ship in order to convey it to a land-based usage site, for example.

The two ships are moored side-by-side and the docking protection devices (16) are inserted between the hulls of the ships to protect them. A distance of approximately 4 to 5 m separates the hulls of the two surface installations.

The size of the LPG storage ship is much smaller than that of the FPSO ship, such that a height difference of several meters, for example 10 m, exists between the freeboard heights of the two installations.

The FPSO has a piping (not shown), while the LPG storage ship has a manifold (20) near the edge of the ship. The fluid transfer device stored on the FPSO is deployed to link the two fluid connection members separated by several tens of meters in height, and to ensure loading of the vats of the LPG storage ship.

The fluid transfer system (10) comprises a support and guide structure (40), a link (52), a winch (51) on which the link (52) is wound, and a tubular transfer conduit (25) having a first end (28) connected to the piping of the first surface installation (11) and a second end (29) that is designed to be connected to the manifold (20) of the second surface installation (12). The tubular transfer conduit (25) is suspended by the link (52) from the support and guide structure (40).

The support and guide structure (40) is mounted on the deck of the first surface installation (11) in a dedicated space. The support and guide structure (40) is mounted on a base (46) on the deck of the first surface installation (11). It rotates around a horizontal axis of rotation and a vertical axis. The support structure is formed by a hinged arm (41) comprising a first arm (42) and a second arm forming a swing tray (43), as will be explained later. The two arms (42, 43) are interconnected by a hinge with a horizontal axis. The first arm (42) is inclined by about 60° with respect to a horizontal axis, while the second arm (43) forms an open angle with the first arm segment (42).

The second arm (43) supports both a counterweight (50) and a winch (51) on which the link (52) is wound. This link is deployed such that a part of the link (52) extends vertically downward from the end of the second hinged arm (43) across from that bearing the counterweight. It is connected to the tubular transfer conduit (25). The link (52) is for example a metal cable, a synthetic cable or a chain. Advantageously, the link (52) is a metal cable.

The tubular transfer conduit (25) is suspended below the support and guide structure (40) by the link (52) at a point of the tubular transfer conduit (25) situated separated from its ends. The tubular transfer conduit (25) comprises a first flexible section (30), a second flexible section (32) and an elbow connection (31) positioned between the first and second flexible sections (32).

The first flexible section (30) extends in a catenary from its end connected to the piping of the first surface installation (11). The second flexible section (32) extends substantially vertically. Its free end (29) is provided with a connection device (27) designed to be connected to the manifold (20) of the second surface installation (12). The connection device in particular comprises an emergency release connector (ERC) and a quick connect and disconnect connector (QCDC).

Advantageously, the connection device is positioned on an elbow connection to make the connection on the manifold (20) of the second surface installation (12) in a substantially horizontal axis.

The second flexible section (32) is very long, for example longer than 10 m. In fact, since a difference of several meters exists between the freeboard heights of the two ships, the manifold (20) of the storage ship of the second surface installation (12) is located much lower than the piping of the first surface installation (11). The accessibility of the manifold (20) of the second surface installation (12) is therefore limited from the first surface installation (11). The connection is thus facilitated owing to the considerable length of the second flexible section (32), which extends vertically from the support and guide structure (40). Additionally, the end (29) is free in all six degrees of freedom, which imparts additional flexibility to the fluid transfer device and thereby limits the forces on the manifold (20).

The flexible conduits are cryogenic LPG transport conduits.

An elbow connection (31) is inserted between the first and second flexible sections (32). This is a small section forming an upside down U, the ends of which are oriented downward. The link (52) of the fluid transfer system (10) is connected at one point on that elbow connection (31). The transfer conduit is then suspended below the support and guide structure (40) by the link (52) connected on the elbow connection (31).

Advantageously, the elbow connection (31) is rigid and includes flexible/rigid connections (36) at its opposite ends to connect the first and second flexible sections.

The curve radius of this elbow connection (31) is very small, advantageously smaller than the minimum curve radius of a flexible conduit, which makes it possible to have a very compact fluid transfer device.

The link length (52) that extends vertically is adjustable by unwinding or winding the link (52) from the winch (51) so as to position the second end (29) of the tubular conduit suitably in view of its connection on the manifold (20) of the second surface installation (12).

According to a second embodiment of the invention (not shown), the fluid transfer system (10) previously described and illustrated by FIG. 4 further comprises a fluid swivel positioned on the tubular transfer conduit (25). Thus, it comprises a first flexible section (30) deployed in a catenary, a second flexible section (32) deployed vertically and a rigid elbow connection (31). According to the second embodiment, the elbow connection comprises a fluid swivel that allows the second flexible section (32) to rotate 360° around a substantially horizontal axis. This additional flexibility imparted to the second flexible conduit section (32) makes it possible to further widen the working window to perform the fluid transfer without imposing unacceptable stresses in terms of safety on the fluid transfer device. This swivel joint positioned wisely on the elbow connection of the transfer conduit (25) makes it possible to further reduce the likelihood of an emergency disconnect compared to the first embodiment and the disconnect system of the prior art.

One operating mode of this fluid transfer system (10) will now be described in light of FIGS. 1 to 6, illustrating different steps of the connection method.

Figure 1:
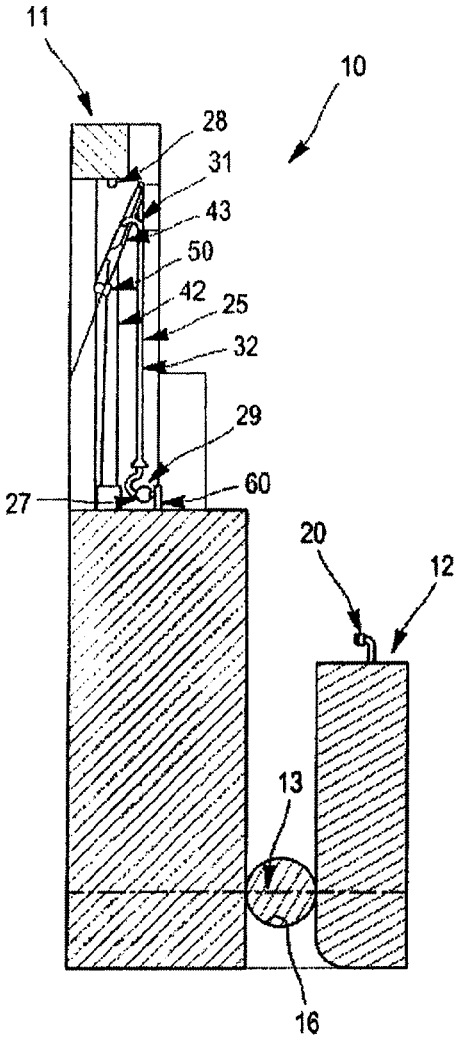
FIG. 1 is a view of the transfer system in its storage position on the first surface installation.

FIG. 1 shows the fluid transfer system (10) in its storage position on the first surface installation (11), for example an FPSO. It comprises the tubular transfer conduit (25) suspended below the support and guide structure (40). The fluid transfer system (10) is stored in a space formed for that purpose on the first surface installation (11). The hinged arm (41) is folded toward the inside. The first arm (42) extends substantially vertically and the second arm (43) extends in the extension of the first arm (42) while forming a maximum opening angle with the first arm (42). The second end (29) of the tubular transfer conduit (25) is fastened to a connector (60) to immobilize the second end (29) of the flexible conduit and drain the tubular conduit (25). In fact, the connector (60) is in fluid communication with the storage vats of the first surface installation (11).

Figure 2:
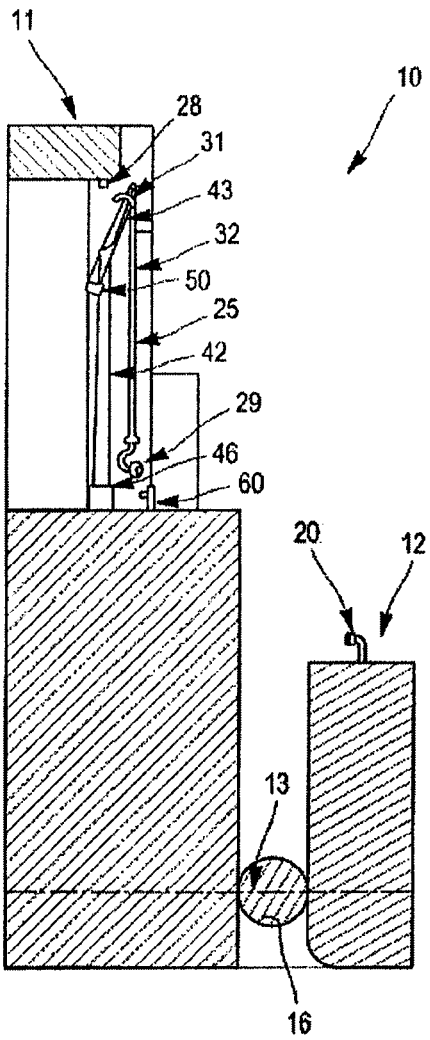
FIGS. 2-5 are views showing the successive steps of the deployment of the transfer system between the first and second surface installations.

In FIGS. 1 and 2, the first flexible conduit section in a catenary is not shown so as to make the figures more clear.

In a first step illustrated by FIG. 2, the second end (29) of the tubular transfer conduit (25) is disconnected from the connector (60) of the first surface installation (11). The link (52) is wound on the winch (51) so as to free the second free end (29) of the tubular transfer conduit (25). The support and guide structure (40) is next oriented by rotating the first arm (42) around its vertical axis to put itself in the axis of the loading plane.

Figure 3:
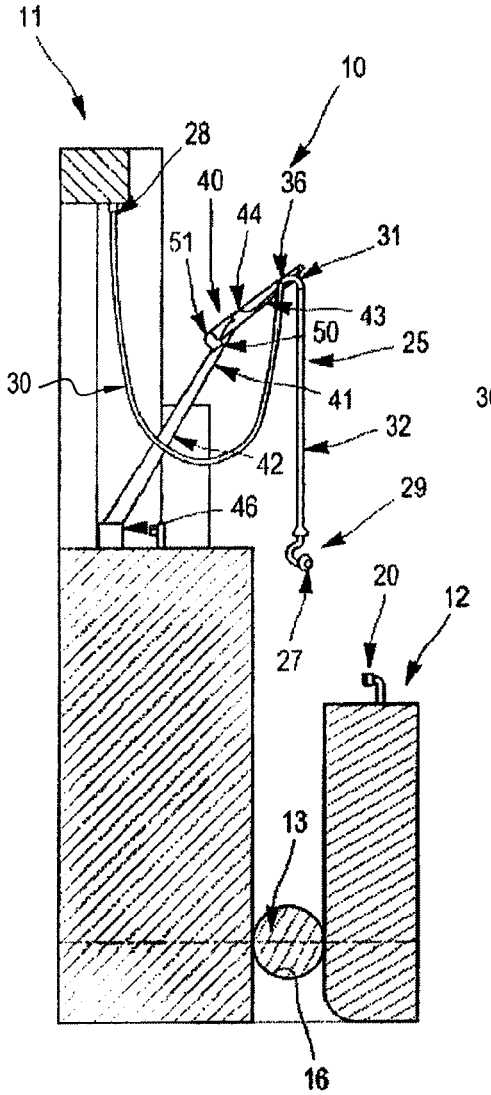

In a second step illustrated by FIG. 3, the support and guide structure (40) is deployed by pivoting the hinged arm (41). The first arm (42) is inclined by pivoting around its horizontal axis of rotation, for example by a 60° angle to bring the second arm (43) past the hull. The second flexible section (32) is then suspended above the surface of the water and the docking protection devices (16).

In a third step illustrated by FIG. 4, the position along the vertical axis of the second vertical flexible conduit (32) is adjusted by deploying a link length (52) that is adequate to lower the second end (29) of the fluid transfer conduit (25) and thus bring it closer to the manifold (20) of the second surface installation (12).

Figure 5:
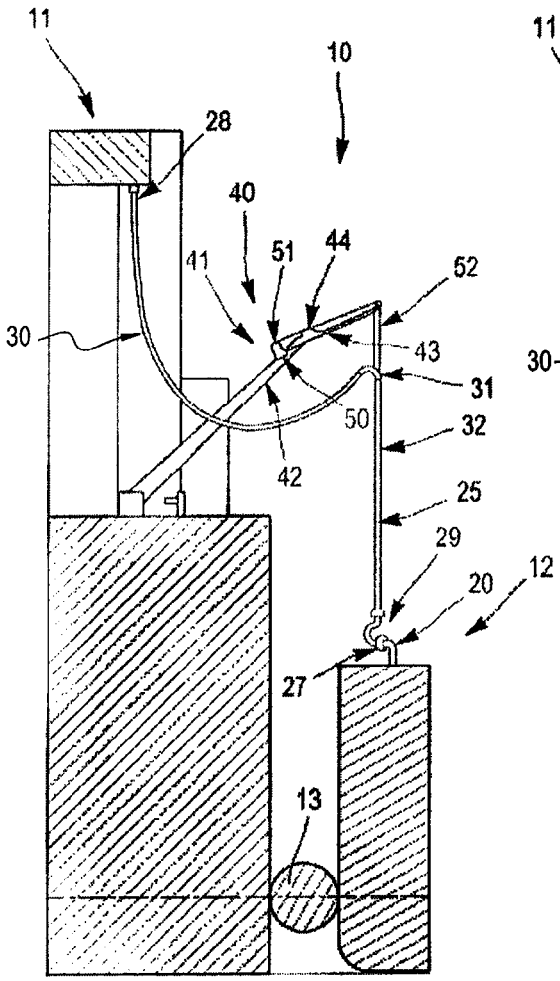

In a fourth step illustrated by FIG. 5, the first arm (42) is inclined again until it forms a 45° angle with respect to the horizontal, thereby bringing the connection device of the second end (29) of the tubular transfer conduit (25) across from the connection device of the manifold (20) of the second surface installation (12). The tubular conduit is connected on the manifold (20).

Figure 6:
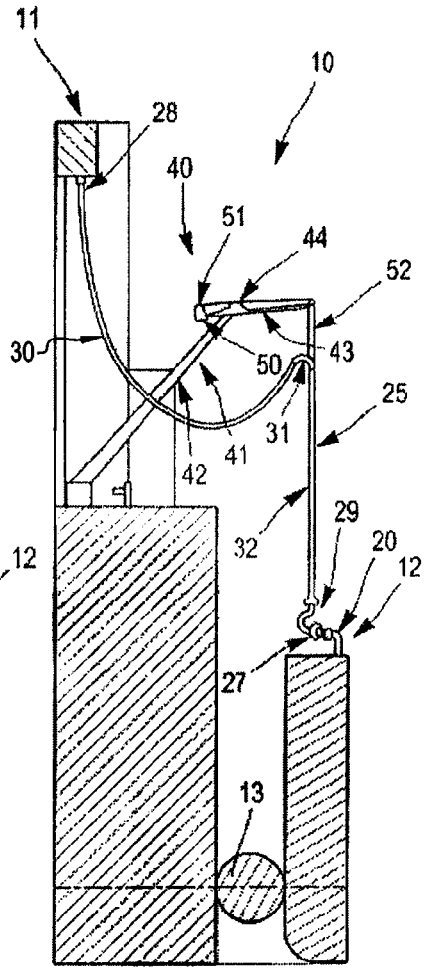
FIG. 6 is a view showing the transfer system in its position connected to the manifold device of the second surface installation.

In a fifth step illustrated in FIG. 6, the second arm (43) forming a swing tray is brought into a substantially horizontal position. Once the connection is done on the manifold (20), the link (52) is wound so that the second arm (43) is substantially horizontal. The winch is then locked. The rotation of the second arm (43) makes it possible to follow the differential movement between the boats. Owing to its counterweight, the second arm (43) can rotate around a horizontal axis at its fastening point (44). The counterweight (50) makes it possible to stabilize a state of equilibrium during the connection of the end of the second flexible conduit (32) on the manifold (20) and during the fluid transfer to follow the movements while limiting the risks of overloads on the manifold (20).

Although the invention has been described for an LPG transfer system, it may apply to transfer systems for other fluids, for example such as LNG or petroleum. Thus, modifications may be made to the invention. For example, the surface installations may be barges, platforms, or storage ships for various fluids. The fluid transfer system is not limited to transferring LPG between an FPSO and an LPG storage ship.

For example, the tubular conduit may be a flexible conduit in a single piece, in which case the elbow connection is a gutter in which the flexible conduit bears. The link is then connected on the gutter. This solution is not, however, favored, since the curve radius of the gutter may not be smaller than the minimum curve radius of the flexible conduit. The system is then less compact. The invention is also not limited to cryogenic flexible conduits, but includes bonded and unbonded flexible conduits as described in standards API17J and API RP17B of the American Petroleum Institute.

What is claimed is:

1. A system for transferring a fluid between a first surface installation and a second surface installation comprising a tubular transfer conduit that can be deployed between the two surface facilities, the first end of which is connected to a piping of the first surface installation while the second end is designed to be connected to a manifold of the second surface installation, the tubular transfer conduit being suspended below a support and guide structure, located on the first surface installation, by a link, wherein the tubular transfer conduit comprises:

a discrete first flexible section extending in a catenary;

a discrete second flexible section extending vertically, the free end of which emerging downward is provided with a connection device designed to be connected to the manifold of the second surface installation; and a rigid elbow connection positioned between the first and second flexible sections, the tubular transfer conduit being suspended below the support and guide structure by a link linking the support structure and a point of the elbow connection, the second flexible section extending vertically at the end connected to the elbow connection, the connection device being positioned on a second elbow connection in order to connect to the manifold of the second surface installation along a substantially horizontal axis, and the second flexible section extending substantially vertically at the end connected to the second elbow connection.

2. The fluid transfer system according to claim 1, wherein the second flexible section has a length greater than 10 m.

3. The fluid transfer system according to claim 1, wherein the rigid elbow connection is rigid and provided with flexible/rigid connectors at each of its opposite ends and has two rectilinear sections, the axes of which form an angle comprised between 30° and 120°.

4. The fluid transfer system according to claim 1, wherein the support and guide structure is a hinged arm rotatably mounted around a horizontal axis on the first surface installation and bears a winch to deploy a given link length between the hinged arm and the point of the rigid elbow connection.

5. The fluid transfer system according to claim 4, wherein the hinged arm comprises a first arm mounted around a horizontal axis on the first surface installation and at the end of which a second arm is rotatably mounted supporting a counterweight, thereby forming a swing tray and making it possible to stabilize a state of equilibrium during the connection of the end of the second flexible conduit on the manifold of the second surface installation.

6. The fluid transfer system according to claim 4, wherein the first arm comprises a vertical axis of rotation to put itself in the axis of the loading plane.

7. The fluid transfer system according to claim 3, wherein the rigid elbow connection comprises a fluid swivel.

8. The fluid transfer system according to claim 1, wherein the link is a metal cable.

* * * * *